US006717563B2

(12) United States Patent
Kim

(10) Patent No.: US 6,717,563 B2
(45) Date of Patent: Apr. 6, 2004

(54) METHOD OF DRIVING LIQUID CRYSTAL DISPLAY PANEL USING SUPERPOSED GATE PULSES

(75) Inventor: Woo Hyun Kim, Seoul (KR)

(73) Assignee: LG Philips LCD Co., Ltd., Seoul (KR)

( * ) Notice: Subject to any disclaimer, the term of this patent is extended or adjusted under 35 U.S.C. 154(b) by 86 days.

(21) Appl. No.: 10/028,714

(22) Filed: Dec. 28, 2001

(65) Prior Publication Data

US 2002/0154085 A1 Oct. 24, 2002

(30) Foreign Application Priority Data

Apr. 21, 2001 (KR) ..... P2001-21584

(51) Int. Cl.[7] ..... G09G 3/36
(52) U.S. Cl. ..... 345/96; 345/94
(58) Field of Search ..... 345/94, 96, 208, 345/209, 87, 90

(56) References Cited

U.S. PATENT DOCUMENTS 6,335,719 B1 * 1/2002 An et al. ..... 345/98
6,335,721 B1 * 1/2002 Jeong ..... 345/100
6,342,876 B1 * 1/2002 Kim ..... 345/87
6,429,842 B1 * 8/2002 Shin et al. ..... 345/92
6,515,647 B1 * 2/2003 Sakamoto ..... 345/99
6,559,822 B2 * 5/2003 Okuzono ..... 345/96

* cited by examiner

*Primary Examiner*—Kent Chang
(74) *Attorney, Agent, or Firm*—Birch, Stewart, Kolasch & Birch, LLP

(57) ABSTRACT

A method of driving a liquid crystal display panel including the steps of sequentially applying first-polarity gate pulses to odd-numbered gate lines of the liquid crystal display panel such that a portion of one of first-polarity gate pulse applied to one odd-numbered gate line is superposed with at least another first-polarity gate pulse applied to a second odd-number gate line; sequentially applying second-polarity gate pulses to even-numbered gate lines of the liquid crystal display panel such that a portion of one second-polarity gate pulse applied to one even-numbered gate line is superposed with another second-polarity gate pulse applied to a second even-numbered gate line; and applying data pulses to the data lines in synchronization with the gate pulses. The liquid crystal display panel has pixels arranged at intersections between gate lines and data lines.

8 Claims, 9 Drawing Sheets

FIG. 3A
CONVENTIONAL ART

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

FIG. 3B
CONVENTIONAL ART

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

FIG. 4A
CONVENTIONAL ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG. 4B
CONVENTIONAL ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 5A
CONVENTIONAL ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 5B
CONVENTIONAL ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

METHOD OF DRIVING LIQUID CRYSTAL DISPLAY PANEL USING SUPERPOSED GATE PULSES

This nonprovisional application claims priority under 35 U.S.C. §119(a) on Patent Application No. P2001-21584 filed in Korea on Apr. 21, 2001, which is herein incorporated by reference.

BACKGROUND OF THE INVENTION

1. Field of the Invention

This invention relates to a method of driving a liquid crystal display panel of dot inversion or line inversion system, and more particularly to a method of driving a liquid crystal display panel using sequentially applied superposed gate pulses.

2. Description of the Background Art

Generally, a liquid crystal display (LCD) controls a light transmittance of each liquid crystal cell in accordance with a video signal to display a picture. An active matrix LCD including a switching device for each liquid crystal cell is suitable for displaying a dynamic image. The active matrix LCD uses thin film transistors (TFTs) as switching devices.

The active matrix LCD can be made into a device that is smaller in size than the existing Braun tube. Therefore, the active matrix LCD has been widely used for a monitor for a personal computer, or a notebook computer as well as office automation equipment such as a copy machine, etc. and portable equipment such as a cellular phone and a pager, etc.

FIG. 1 shows a schematic configuration of a typical LCD.

Referring to FIG. 1, the LCD includes a gate driver 12 for driving gate lines GL1 to GLn on a liquid crystal display panel 10, and a data driver 14 for driving data lines DL1 to DLm crossing the gate lines GL1 to GLn. The LCD panel 10 has pixels PE which are each arranged at an area divided by the gate lines GL1 to GLn and the data lines DL1 to DLm. Each pixel includes a liquid crystal cell CLC for responding to an electric field to control a transmitted light amount, and a TFT for responding to gate signals at the gate lines GL1 to GLn to selectively connect the data lines DL1 to DLm to the liquid crystal cells CLC.

The gate driver 12 responds to a gate control signal from a timing controller 16 to drive n gate lines GL1 to GLn sequentially by one horizontal synchronous interval every frame. In response to a data control signal from the timing controller 16 the data driver 14 supplies pixel data to the data lines DL1 to DLn whenever the gate lines GL1 to GLn are enabled.

FIG. 2 shows a conventional equivalent circuit of each pixel PE on the LCD panel in FIG. 1.

Referring to FIG. 2, the pixel PE includes a TFT connected between the gate line GLn and the data line DL, and a liquid crystal cell ClC connected between a source terminal of the TFT and a common voltage line CL. During operation, the liquid crystal cell ClC charges a difference voltage between a video signal on the data line DL and a common voltage Vcom from the common voltage line CL during one horizontal synchronizing signal interval. The interval occurs when the TFT keeps a turn-on state, and that is when a gate high voltage is applied to the gate line GL. Thus, the difference voltage charged in the liquid crystal cell ClC becomes different depending on the polarity of a video signal and the data driver 14.

Such a LCD uses five driving methods such as a line inversion system, a column inversion system, a dot inversion system, a two-dot inversion system and a group inversion system so as to drive the liquid crystal cells of the liquid crystal display panel.

In the line inversion system, the polarities of data signals applied to the LCD panel become different depending on row lines, which correspond to the gate lines on the liquid crystal display panel, as shown in FIG. 3A. The polarities of the data signals are again inverted on a frame basis, as shown in FIG. 3B.

In the column inversion system, the polarities of data signals applied to the LCD panel become different depending on column lines, which correspond to the data lines on the liquid crystal display panel, as shown in FIG. 4A. Again, the polarities of the data signals may be inverted on a frame basis, as shown in FIG. 4B.

In the dot inversion system, as shown in FIG. 5A, contrary polarities of data signals are applied to adjacent liquid crystal cells for each column line and each row line on the liquid crystal display panel. As shown in FIG. 5B, the polarities of data signals applied to all liquid crystal cells of the LCD panel are inverted for every frame. In other words, when video signals of a certain frame are displayed, data signals are applied to the liquid crystal cells of the LCD panel such that positive polarity (+) and negative polarity (−) alternates as the liquid crystal cells go from the left upper side to the right side, and into the lower side, as shown in FIG. 5A. Subsequently, when video signals at the next frame are displayed, data signals applied to the liquid crystal cells are inverted to be contrary to the previous frame as shown in FIG. 5B.

In the dot inversion system, polarities of data signals are inverted at all pixels in the vertical and horizontal directions to have advantages of both the line inversion system and the column inversion system. As a result, a picture of excellent quality is provided. Further, the LCD panel driving methods adopting the dot inversion system has recently been widely utilized due to these advantages.

A panel with the TFT LCD tends toward a higher resolution and a larger scale picture. As the resolution of the LCD becomes higher, a high-speed operation is required to shorten the horizontal synchronizing signal interval. Thus, a width of a gate signal is not only reduced, but also the time permitting a video signal to be applied to the liquid crystal cell is reduced. This causes a disadvantage in that a time margin capable of charging a data voltage in a pixel in the case of a resolution of SXGA (1280*1024) or UXGA (1600*1200) is not sufficient.

To overcome this disadvantage, an attempt of pre-charging mutually superposing gate signals applied to any adjacent gate line has been made to allow input of data for the preceding pixel in advance prior to inputting real data.

This attempt is based on the assumptions that the first gate line to the nth gate line of the liquid crystal display panel should be GL1, GL2, GL3, . . . , GLi, . . . GLn−1, GLn; the first data line to the mth data line be DL1, DL2, DL3, . . . , DLj, . . . , DLm−1, DLm; a pixel supplied with a data at the jth data line DLj by a gate pulse at the ith gate line GLi is $P_{i,j}$; and a pixel supplied with a data at the jth data line DLj by a gate pulse at the (i+1)th gate line GLi+1 be $P_{i+1,j}$.

In the prior art, video signals are applied in such a manner that signals at the two adjacent gate lines GLi and GLi+1 in correspondence with a pixel $P_{i,j}$ and the next pixel $P_{i+1,j}$ are superposed with each other. If a gate signal is applied to the ith gate line GLi, then video data is supplied to the pixel $P_{i,j}$. If signals of the two gate lines GLi and GLi+1 are superposed with each other, then a portion of a signal having a polarity different from the video signal that previously charged the pixel $P_{i+1,j}$ is applied to change its polarity in advance with the aid of a video signal applied to the pixel $P_{i,j}$. This strategy is applicable to the column inversion system in which the pixels $P_{i,j}$ and $P_{i+1,j}$ have the same polarity at the same frame. However, such a driving method of merely superposing two adjacent gate signals can not be applied to the line inversion or dot inversion system in which a different polarity is applied to upper and lower adjacent pixels.

A pre-charging driving scheme applicable to the line inversion or dot inversion system has been disclosed in Japanese Patent Laid-open Gazette No. Pyung 6-118910. This scheme applies a sub-pulse in advance upon applying data to the preceding pixel having the same polarity prior to application of a main pulse of a gate signal.

However, such a scheme has the following problems. In the case of a higher resolution, the width of a main pulse of a gate signal applied to each gate line GL is reduced. The reduction causes difficulty in pulse-application driving of the LCD panel wherein a main pulse of a gate signal is applied to the nth gate line GLn, and simultaneously, a sub-pulse is applied to the (n+2)th gate line GLn+2; and after a main pulse is applied to the (n+1)th gate line GLn+1, a main pulse is applied to the (n+2)th gate line GLn+2 and, simultaneously, a sub-pulse is applied to the (n+2)th gate line. Furthermore, since the number of scanning lines of the panel is enlarged according to a higher resolution, the time margin large enough to completely charge a data voltage in the pixel is not sufficient due to a delay factor. This deficiency in the line margin causes a deterioration in a display quality such as a deterioration in a color or brightness expression.

SUMMARY OF THE INVENTION

Accordingly, it is an object of the present invention to provide a method of driving a liquid crystal display panel wherein an accurate data voltage is applied to a high-resolution and high-scale LCD panel to improve a charge rate of a pixel and a storage capacitor.

To achieve these and other objects, a method of driving a LCD panel according to one embodiment of the present invention includes the steps of sequentially applying first-polarity gate pulses to odd-numbered gate lines of the liquid crystal display panel such that a portion of the first-polarity gate pulses are superposed at at least adjacent odd-numbered gate lines of the odd-numbered gate lines; sequentially applying second-polarity gate pulses to even-numbered gate lines of the liquid crystal display panel such that a portion of the second-polarity gate pulses are superposed at least adjacent even-numbered gate lines of the even-numbered gate lines; and applying data pulses to data lines in synchronization with the gate pulses.

In the method, the even-numbered gate lines are turned off when the first polarity gate pulses are applied to the odd-numbered gate lines. On the other hand, the odd-numbered gate lines are turned off when the second polarity gate pulses are applied to the even-numbered gate lines.

In the method, a pulse width of the gate signal is larger than one horizontal scanning interval. Also, a pulse width of the superposing gate signal may be set to be less than 3 $\mu$s.

Further, the data pulses applied to the adjacent data lines in the data lines for supplying the data pulses to the liquid crystal display panel have the polarities contrary to each other.

BRIEF DESCRIPTION OF THE DRAWINGS

These and other objects of the invention will be apparent from the following detailed description of the embodiments of the present invention with reference to the accompanying drawings, in which:

FIG. 3A and FIG. 3B depict a conventional line inversion system;

FIG. 4A and FIG. 4B depict a conventional column inversion system;

FIG. 5A and FIG. 5B depict a conventional dot inversion system;

DETAILED DESCRIPTION OF THE PREFERRED EMBODIMENT

Figure 1:
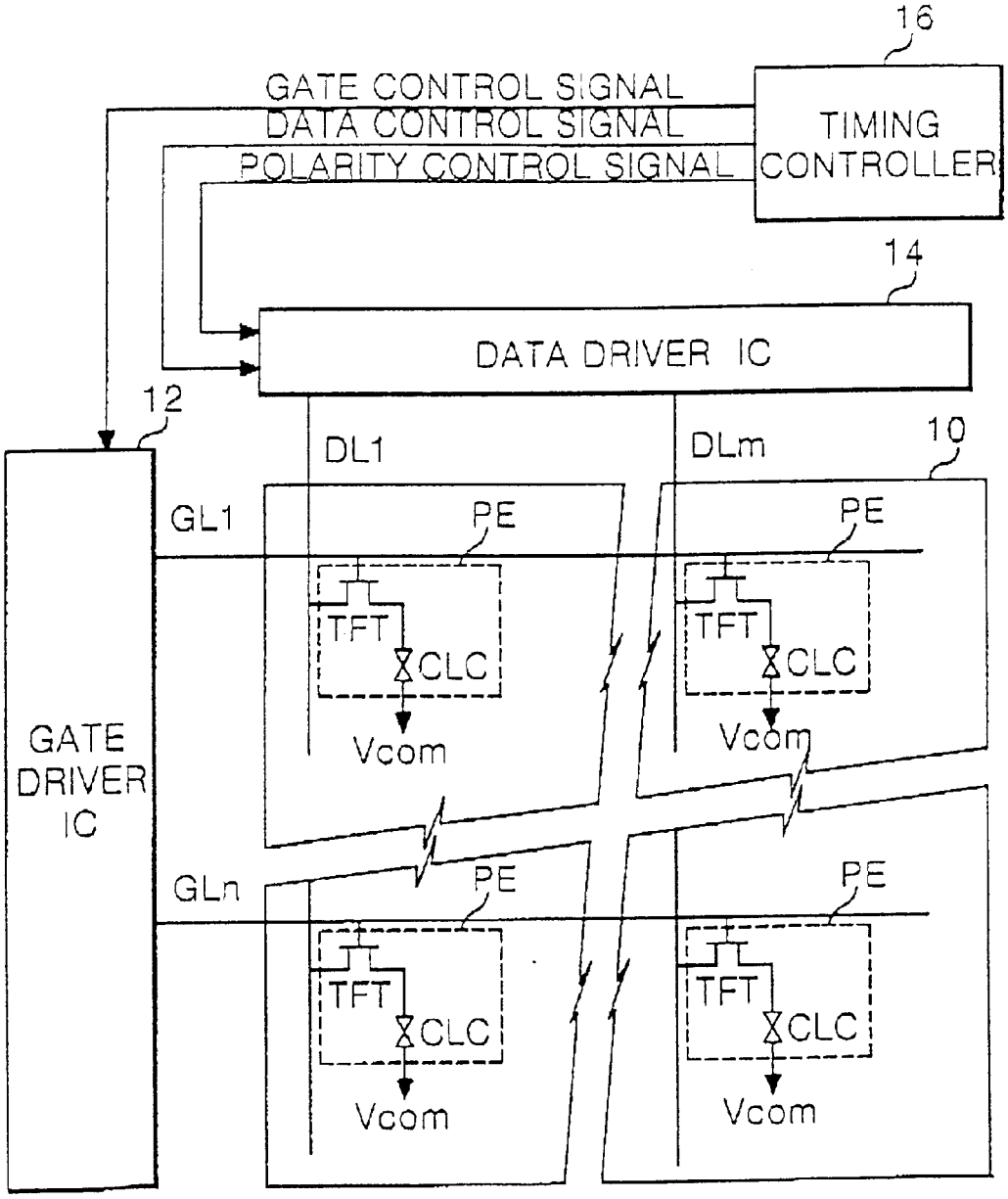
FIG. 1 CONVENTIONAL ART
FIG. 1 is a block circuit diagram depicting a configuration of a conventional LCD.
Figure 2:
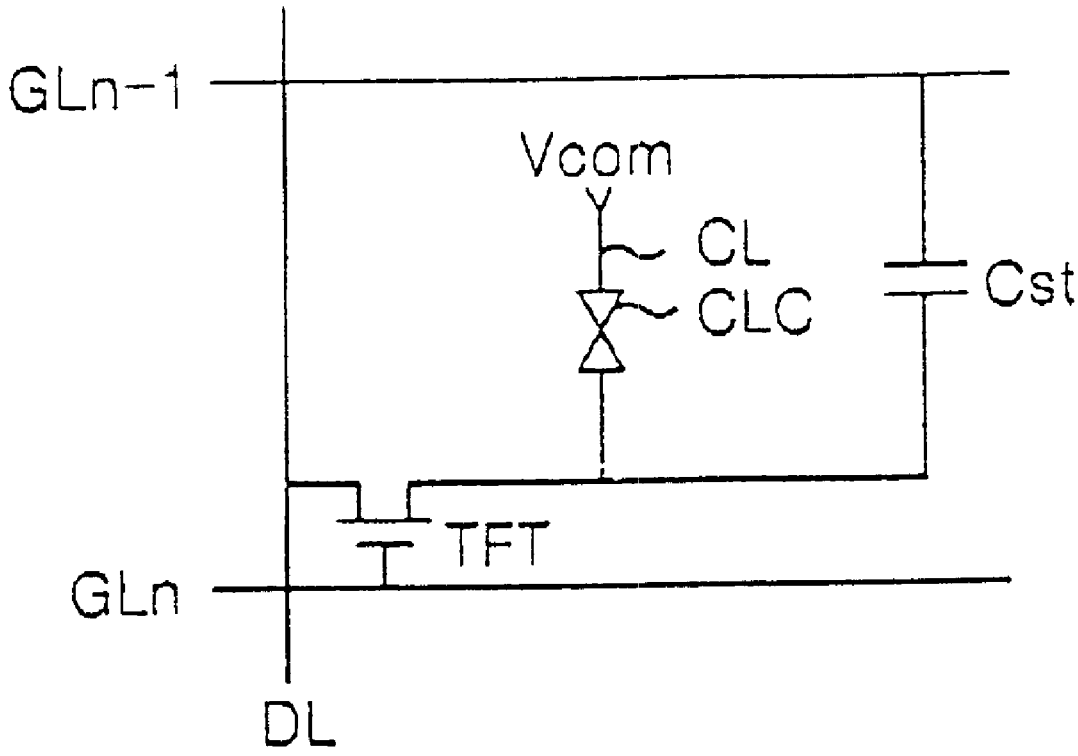
FIG. 2 CONVENTIONAL ART
FIG. 2 depicts an equivalent circuit diagram of each pixel of the LCD panel of FIG. 1.
Figure 6A:
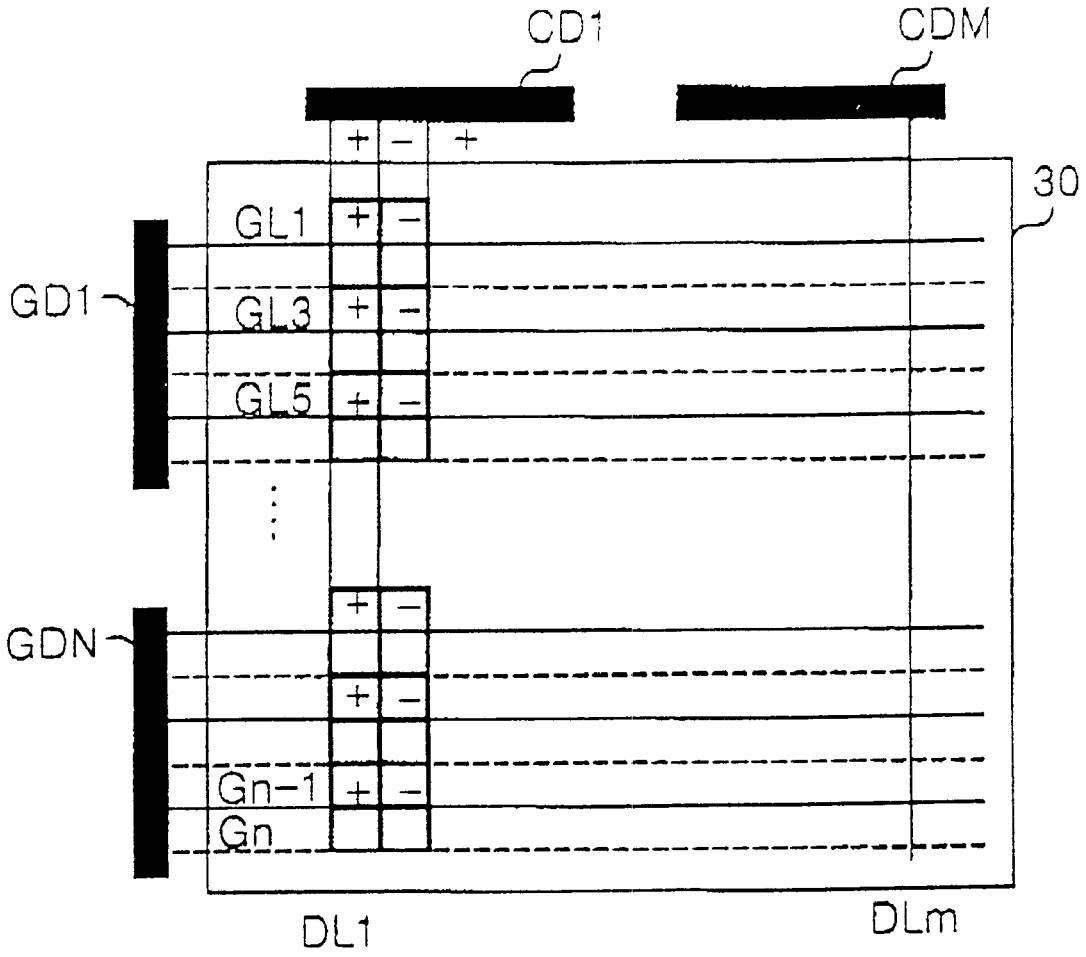
FIG. 6A and FIG. 6B depict a method of driving a liquid crystal display panel, according to one embodiment of the present invention.
Figure 6B:
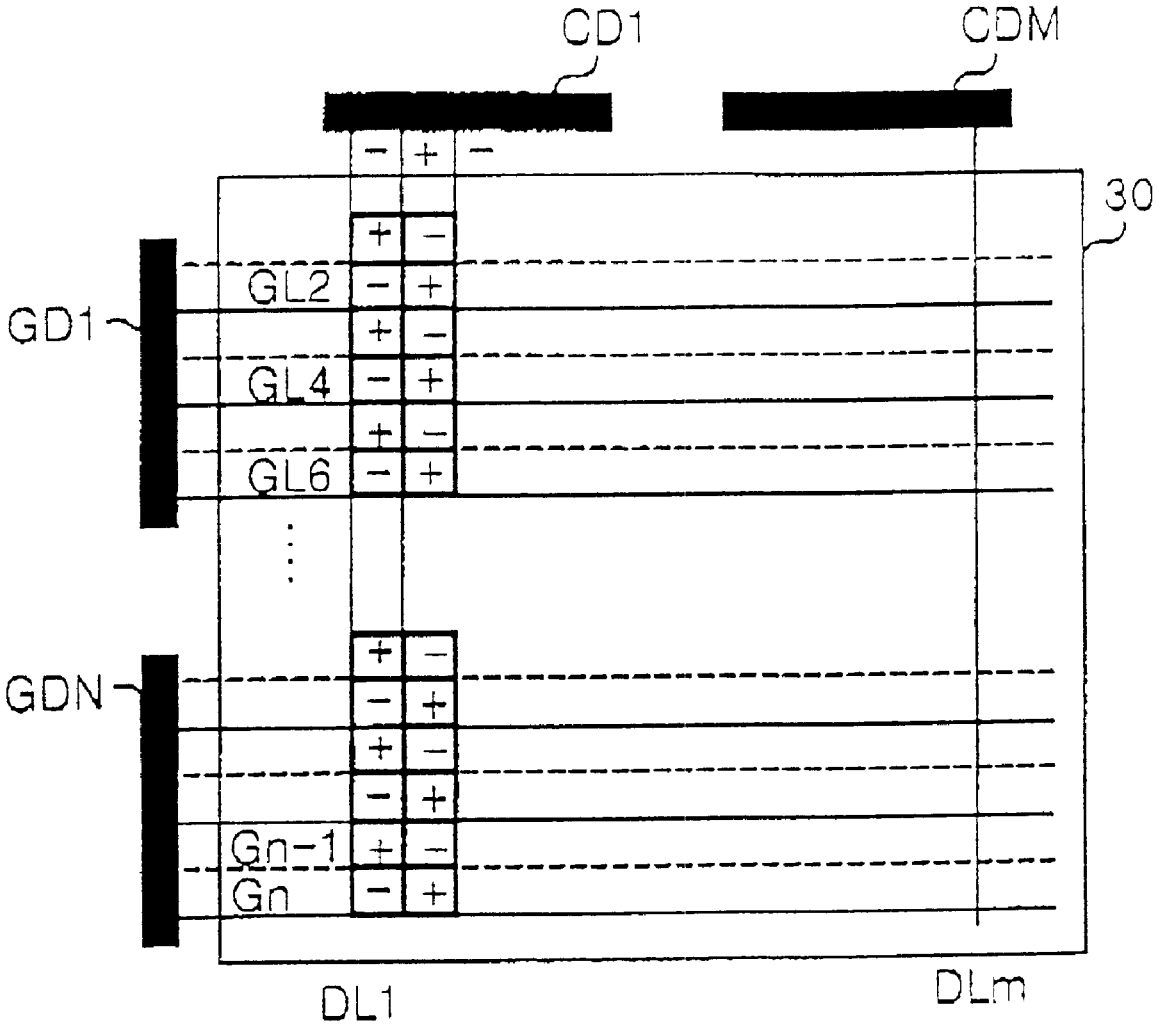
Figure 7:
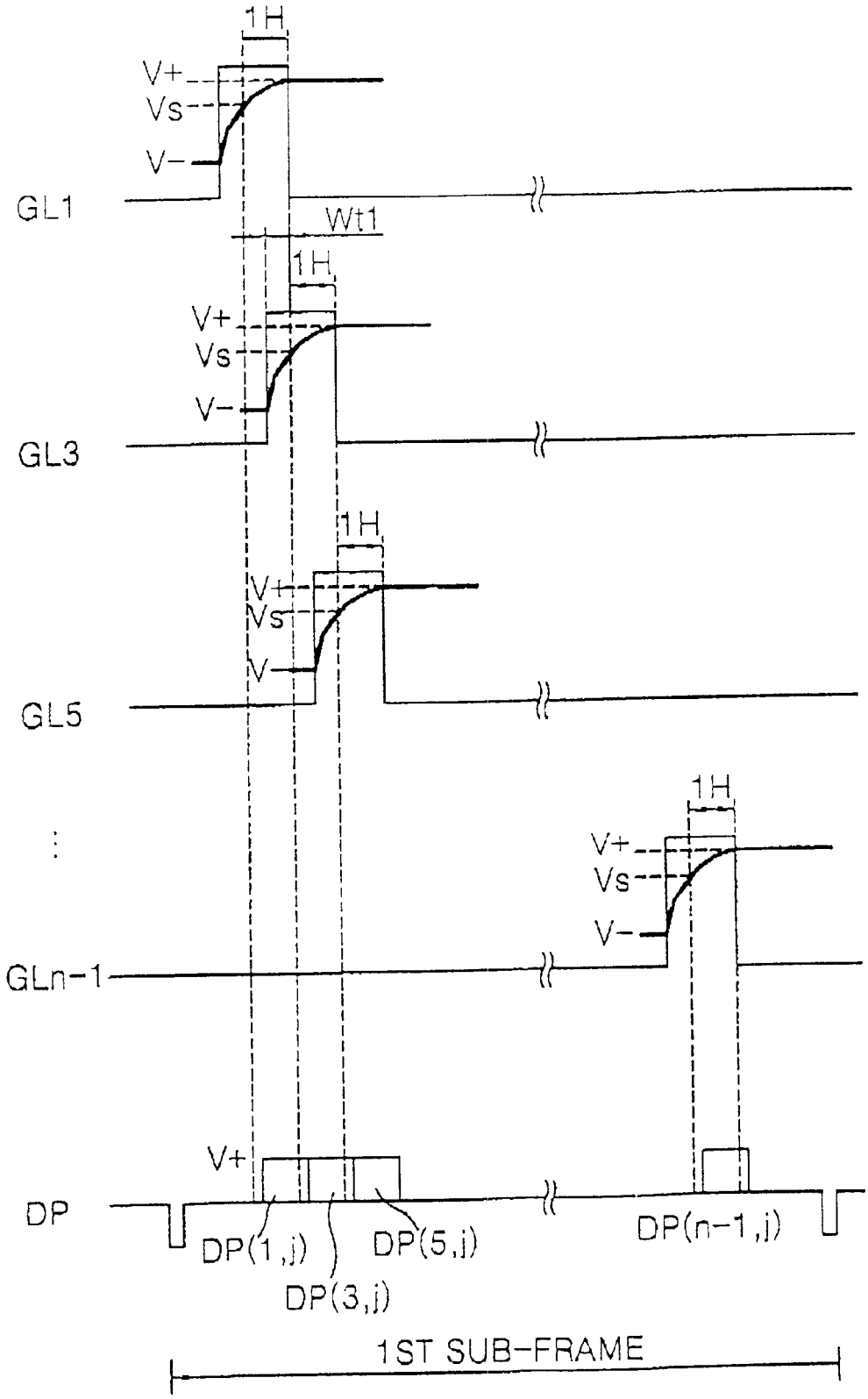
FIG. 7 depicts waveform diagrams of a voltage charge in a pixel and a gate pulse upon driving only the odd-numbered gate lines in the LCD panel, according to the driving method of FIG. 6A.
Figure 8:
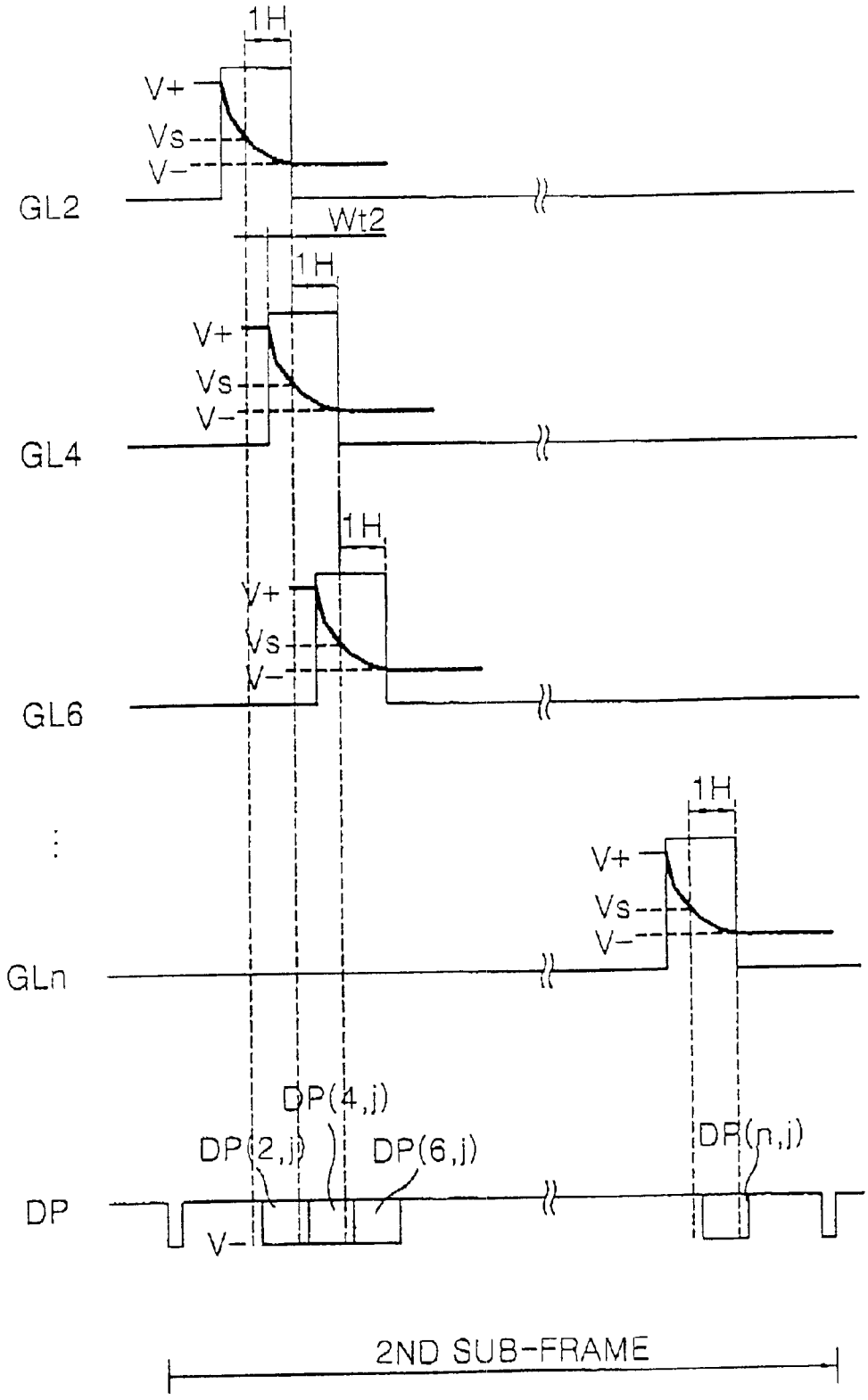
FIG. 8 depicts waveform diagrams of a voltage charge in the pixel and a gate pulse upon driving only the even-numbered gate lines in the LCD panel, according to the driving method of FIG. 6B.

FIGS. 6A, 6B, 7 and 8 depict a method of driving a liquid crystal display panel according to a preferred embodiment of the present invention. FIG. 6A and FIG. 7 depict an example with only the odd-numbered gate lines sequentially driven at the first sub-frame to charge a pixel. FIG. 6B and FIG. 8 depict an example with only the even-numbered gate lines sequentially driven at the second sub-frame to charge a pixel.

A liquid crystal panel 30 having liquid crystal cells arranged in a matrix type is shown in FIG. 6A. M data driver integrated circuits (ICS) CD1 to CDM for applying video signals to m data lines DL1 to DLm, respectively, and N gate driver ICs GD1 to GDN for driving n gate lines GL1 to GLn, respectively, are shown in conduction with liquid crystal display panel 30. Herein, each of M, N, m and n is an integer.

One frame is divided into two sub-frames (as shown in FIGS. 6A and 6B), each of which has a time interval equal to a half of one vertical synchronizing signal period.

As shown in FIG. 6A, in the first sub-frame interval, the M data driver ICS CD1 to CDM sequentially apply gate signals G1, G3, G5, . . . , Gn−1 to only the odd-numbered gate lines GL1 to GLn−1 with the aid of the N gate driver ICS GD1 to GDN in such a manner to be superposed with each other for a time Wt1 (refer to FIG. 7), As a result, a positive (+) video signal voltage is charged. On the other hand, in the first sub-frame interval, the even-numbered gate lines GL2 to GLn are kept at a turn-off state. Accordingly, an initial operation of the first frame allows a positive (+) pixel voltage to be charged only by an operation of the odd-numbered gate lines GL1 to GLn−1.

Referring to FIG. 6B, in the second sub-frame interval that occurs after the operation described in FIG. 6A, the M data driver ICS CD1 to CDM sequentially apply gate signals G2, G4, G6, . . . , Gn to only the even-numbered gate lines GL2 to GLn with the aid of the N gate driver ICS GD1 to GDN in such a manner to be superposed with each other for a time Wt2 (refer to FIG. 8). As a result, a negative (−) video signal voltage is charged. At this time, a pixel voltage charged at the previous frame has a positive polarity (+). On the other hand, in the second sub-frame interval, the odd-numbered gate lines GL1 to GLn−1 are kept at a turn-off state. Accordingly, an operation of the second frame allows a negative (−) pixel voltage to be charged only by an operation of the even-numbered gate lines GL2 to GLn.

All the pixels within one field can be charged by the dot inversion system in this manner.

FIGS. 7 and 8 illustrate signal waveforms in consideration of pixels arranged vertically and connected to the jth data line DLj in the LCD panel shown in FIGS. 6A and 6B. FIGS. 7 and 8 provide an explanation as to an operation of inverting the polarity of video data input in such a state of negative positive (+), negative (−), positive (+), negative (−), positive (+), negative (−) and positive (+) video data that has been already applied to the pixels $P_{(1,j)}$, $P_{(2,j)}$, $P_{(3,j)}$, $P_{(4,j)}$, $P_{(5,j)}$, $P_{(6,j)}$, . . . , $P_{(n-1,j)}$ and $P_{(n,j)}$ from the upper portion in the previous frame. Then, applying the polarity-inverted video data. It is assumed that video data of all pixels should be inverted from V+ into V− or vice versa.

Referring to FIG. 7, a data pulse DP is applied to the jth data line DLj and a gate pulse GP is applied to only the odd-numbered gate lines GL1 to GLn−1 with the aid of the N gate driver ICS GD1 to GDN.

As shown FIG. 7, for example, a gate pulse GP applied to the third gate line GL3 prior to gate pulse GP that was applied to the first gate line GL1 is turned off. This allows the gate pulses applied to GL1 and GL3 to be superposed as shown in FIG. 7 for a time Wt1. The superposing of the two gate pulses GPs permits a pre-charging to voltage Vs by a video data pulse DP(1,j) to improve an efficiency in charging a data voltage in the pixel. As shown in FIG. 7, this operation is continued until a gate pulse GP is applied to the last odd-numbered gate line GLn−1. In this example, time Wt1 is, for example, approximately 1 to 3 μs.

Accordingly, upon driving of the odd-numbered gate lines GL1 to GLn−1, a positive (+) data voltage Vd according to each gate pulse having a reference voltage of common voltage Vcom and a maximum voltage of V+ (i.e., about 5V) is charged in the pixel. V− in FIG. 7 represents the minimum gate pulse voltage.

In this subframe, upon application of each gate pulse GP to the odd-numbered gate lines GL1 to GLn−1, a partial charging is made when an initial gate pulse GP is applied and then the next gate pulse GP is applied in such a manner to be superposed by about 1 to 3 μs with the initial gate pulse GP. Thereafter, a charging is made until a maximum V+. Accordingly, the driving method of this embodiment has a smaller level difference than the prior art, so that a faster charging can be made and thus a charge rate of a pixel voltage can be improved.

FIG. 8 illustrates the operation during the second sub-frame wherein a data pulse DP is applied to one data line DL and a gate pulse GP is applied to only the even-numbered gate lines GL2 to GLn with the aid of the N gate driver ICS GD1 to GDN.

The even-numbered gate lines GL2 to GLn are driven in turn, but a gate pulse GP applied to the fourth gate line GL2 is pre-charged until a voltage Vs at a certain time after a gate pulse GP was applied to the second gate line GL4. In this case, an overlapping time Wt2 of the gate pulse with the pre-charged next gate pulse GP is about, for example, 1 to 3 μs.

Accordingly, upon driving of the even-numbered gate lines GL2 to GLn, a negative (−) data voltage Vd according to each gate pulse having a reference voltage of common voltage Vcom and a minimum voltage of V− (i.e., about −5V) is charged in the pixel. This operation is continued until a gate pulse GP is applied to the last even-numbered gate line GLn. Also, this operation exerts the same effect as the fore-mentioned operation at the first sub-frame.

According to the operation as mentioned above, a positive (+) data signal is applied upon operation of the first odd-numbered gate line at the first sub-frame and, after the operation of the odd-numbered gate line is finished, the even-numbered gate line is operated to apply a negative (−) data signal. As a result, a pre-charging can be made in the line inversion or dot inversion system in which the adjacent pixels at the upper and lower portions of the LCD have polarities different from each other.

In the prior art, a gate pulse width of QSXGA+mode is approximately 6 μs, which includes a 2 μs time interval between the gate pulses. However, according to the present invention, the gate pulses are superposed without any time interval, so that a width of the gate pulse is decreased. For example, the width of the gate pulse according to one embodiment of the invention may be calculated by adding 2 μs to the superposing time (i.e., 1 to 3 μs) which yields 3 to 5 μs. Which is on improved a charge rate of the pixel.

In FIG. 7 and FIG. 8, the gate pulse GP is turned off slightly prior to turning off the data pulse DP. This compensates for a picture non-uniformity caused by a distortion of the gate signal caused by the resistance of the gate line and the capacitor during the transfer of the gate signal from the gate driver IC to a pixel with a delay. For instance, after the gate pulse applied to the third gate line GL3 falls, a data pulse DP to be applied to the pixels $P_{(3,1)}$, $P_{(3,2)}$, $P_{(3,3)}$, . . . , $P_{(3,j)}$, . . . and $P_{(3,m)}$ from the data driver IC is turned off. To charge/pixel data into a certain pixel P (i,j), a gate pulse GP from the gate driver IC is applied to the ith gate line GLi and the TFT connected to the pixel $P_{i,j}$ is turned on with the aid of the gate pulse GP. When the TFT is turned-on, data to be supplied to the liquid crystal cell is applied from the data driver IC to the jth data line DLj. In consideration of a pixel charging of the liquid crystal cell distant from the gate driver IC, a data signal is applied to the data line DL from the data driver IC in such a manner to fall (i.e., change from positive polarity (+) into negative polarity (−)) or rise (i.e., change from negative polarity (−) into positive polarity (+)) with being delayed by a certain time after a falling time of the gate pulse GP that is an output of the gate driver IC. Assuming that a time constant of the gate line GL is τ, said delay amount is proportional to the time constant τ. A uniform picture cannot be displayed until a delayed amount of the data signal becomes more than 0.5 τ.

As described above, the odd-numbered gate lines are first driven to charge a positive (+) data voltage into the pixel, and thereafter, the even-numbered gate lines are driven to charge a negative (−) data voltage into the pixel. As a result, it becomes possible to enhance a charge rate. Furthermore, upon driving of each of the odd-numbered and even-numbered gate lines, the next respective odd or even gate line is driven in advance at a certain time after a data voltage began to charge the pixel at the firstly driven gate line. As a result, the charge rate is improved.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal display panel having pixels arranged at intersections between gate lines and data lines in a matrix type, said method comprising the steps of:

sequentially applying first-polarity gate pulses to odd-numbered gate lines of the liquid crystal display panel such that a portion of one first-polarity gate pulse that is applied to a first odd-numbered gate line is superposed with another first-polarity gate pulse that is applied to a second odd-numbered gate line;

sequentially applying second-polarity gate pulses to even-numbered gate lines of the liquid crystal display panel such that a portion of one second-polarity gate pulse that is applied to a first even-numbered gate line is superposed a another second-polarity gate pulse that is applied to a second even-numbered gate line; and applying data pulses to the data lines in synchronization with the gate pulses.

2. The method according to claim 1, wherein the even-numbered gate lines are turned off when the first-polarity gate pulses are applied to the odd-numbered gate lines.

3. The method according to claim 1, wherein the odd-numbered gate lines are turned off when the second-polarity gate pulses are applied to the even-numbered gate lines.

4. The method according to claim 1, wherein a pulse width of the gate signal is larger than one horizontal scanning interval.

5. The method according to claim 1, wherein a pulse width of the superposing gate signal is set to be less than 3 $\mu$s.

6. The method according to claim 1, wherein the data pulses applied to the adjacent data lines for supplying the data pulses to the liquid crystal display panel have polarities contrary to each other.

7. The method according to claim 1, wherein the one is adjacent the second first-polarity gate pulse.

8. The method according to claim 1, wherein the first second-polarity gate pulse is adjacent the second second-polarity gate pulse.

* * * * *